US011137001B2

(12) United States Patent
Tanaka et al.

(10) Patent No.: US 11,137,001 B2
(45) Date of Patent: Oct. 5, 2021

(54) HYDRAULIC DRIVE APPARATUS

(71) Applicant: KAWASAKI JUKOGYO KABUSHIKI KAISHA, Kobe (JP)

(72) Inventors: Hideki Tanaka, Nishinomiya (JP); Hideki Watanabe, Kobe (JP); Isamu Yoshimura, Kobe (JP); Tomohide Hattori, Kobe (JP); Mariko Ogata, Kobe (JP); Tadashi Anada, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 9 days.

(21) Appl. No.: 16/636,077

(22) PCT Filed: Jul. 31, 2018

(86) PCT No.: PCT/JP2018/028612
§ 371 (c)(1),
(2) Date: Feb. 3, 2020

(87) PCT Pub. No.: WO2019/026892
PCT Pub. Date: Feb. 7, 2019

(65) Prior Publication Data

US 2020/0248719 A1 Aug. 6, 2020

(30) Foreign Application Priority Data

Aug. 2, 2017 (JP) ..... JP2017-150164

(51) Int. Cl.
*F15B 15/18* (2006.01)
*F04B 1/22* (2006.01)
(Continued)

(52) U.S. Cl.
CPC ..... *F15B 15/18* (2013.01); *F04B 1/22* (2013.01); *F04B 49/08* (2013.01); *F15B 11/00* (2013.01);
(Continued)

(58) Field of Classification Search
CPC ..... F15B 15/18
(Continued)

(56) References Cited

U.S. PATENT DOCUMENTS 4,145,884 A 3/1979 Childs
4,667,472 A * 5/1987 Clay ..... G05D 1/0061 60/476
(Continued)

FOREIGN PATENT DOCUMENTS

JP 2004-257448 A 9/2004
JP 2005-308047 A 11/2005
(Continued)

*Primary Examiner* — Michael Leslie
(74) *Attorney, Agent, or Firm* — Oliff PLC

(57) ABSTRACT

A hydraulic drive apparatus includes: an electric motor; a variable displacement pump driven by the electric motor, the pump including a pair of pump ports whose delivery side and suction side are switched with each other in accordance with a rotation direction of the electric motor; a hydraulic actuator connected to the pair of pump ports by a first supply/discharge line and a second supply/discharge line; and a control device that controls the electric motor based on an actuator position command value for the hydraulic actuator. The pump is configured such that a volume of the pump decreases in accordance with increase in a pressure difference between the first supply/discharge line and the second supply/discharge line.

5 Claims, 6 Drawing Sheets

(51) Int. Cl.

| | |
|---|---|
| ***F15B 11/00*** | (2006.01) |
| ***F04B 49/08*** | (2006.01) |
| *E02F 9/22* | (2006.01) |
| *F04B 1/324* | (2020.01) |

(52) U.S. Cl.
CPC ..... *E02F 9/2285* (2013.01); *E02F 9/2296* (2013.01); *F04B 1/324* (2013.01); *F15B 2211/20553* (2013.01); *F15B 2211/6652* (2013.01)

(58) Field of Classification Search
USPC ..... 60/476
See application file for complete search history.

(56) References Cited

U.S. PATENT DOCUMENTS 4,707,988 A * 11/1987 Palmers ..... F03G 3/08 60/476
7,055,320 B2 * 6/2006 Nagai ..... B25B 5/061 60/476
7,987,668 B2 * 8/2011 Kakino ..... F15B 15/18 60/452
8,341,956 B2 * 1/2013 Makino ..... F04B 49/002 60/476

FOREIGN PATENT DOCUMENTS

| | | | |
|---|---|---|---|
| JP | 2008-291731 | A | 12/2008 |
| JP | 2017-089564 | A | 5/2017 |
| WO | 2012/122159 | A2 | 9/2012 |

* cited by examiner

HYDRAULIC DRIVE APPARATUS

TECHNICAL FIELD

The present invention relates to a hydraulic drive apparatus that moves a hydraulic actuator by an electric motor.

BACKGROUND ART

Conventionally, there is a known hydraulic drive apparatus that moves a hydraulic actuator by an electric motor (see Patent Literature 1, for example). In the hydraulic drive apparatus, a pump driven by the electric motor includes a pair of pump ports whose delivery side and suction side are switched with each other in accordance with the rotation direction of the electric motor. These pump ports are connected to a hydraulic actuator by a pair of supply/discharge lines.

In such a hydraulic drive apparatus, the hydraulic actuator moves by a moving amount corresponding to a rotation amount of the electric motor. That is, the torque of the electric motor is converted into the thrust of the hydraulic actuator (in a case where the hydraulic actuator is a hydraulic cylinder) or converted into the torque of the hydraulic actuator (in a case where the hydraulic actuator is a hydraulic motor). Both in the case where the hydraulic actuator is a hydraulic cylinder and the case where the hydraulic actuator is a hydraulic motor, the pump functions as a reduction gear that converts the rotational speed of the electric motor into a relatively lower speed (cylinder speed or motor speed) of the hydraulic actuator.

CITATION LIST

Patent Literature

PTL 1: Japanese Laid-Open Patent Application Publication No. 2004-257448

SUMMARY OF INVENTION

Technical Problem

In a conventional hydraulic drive apparatus, the pump is of a fixed displacement type. Accordingly, when the rotational speed and the torque of the electric motor are constant, the thrust or the torque of the hydraulic actuator is also constant.

However, it is desirable that the speed reduction ratio be changeable in accordance with necessary thrust or necessary torque for the hydraulic actuator even when the rotational speed and the torque of the electric motor are constant. For example, in a case where the hydraulic actuator is a hydraulic cylinder, it is desired to decrease the cylinder speed to increase the thrust, or increase the cylinder speed to decrease the thrust.

In view of the above, an object of the present invention is to provide a hydraulic drive apparatus that is capable of changing the speed reduction ratio in accordance with necessary thrust or necessary torque for the hydraulic actuator even when the rotational speed and the torque of the electric motor are constant.

Solution to Problem

In order to solve the above-described problems, a hydraulic drive apparatus according to the present invention includes: an electric motor; a variable displacement pump driven by the electric motor, the pump including a pair of pump ports whose delivery side and suction side are switched with each other in accordance with a rotation direction of the electric motor; a hydraulic actuator connected to the pair of pump ports by a first supply/discharge line and a second supply/discharge line; and a control device that controls the electric motor based on an actuator position command value for the hydraulic actuator. The pump is configured such that a volume of the pump decreases in accordance with increase in a pressure difference between the first supply/discharge line and the second supply/discharge line.

Both in a case where the hydraulic actuator is a hydraulic cylinder and in a case where the hydraulic actuator is a hydraulic motor, normally, the pressure of the supply/discharge line at the hydraulic oil supply side to the hydraulic actuator is higher, and the pressure of the supply/discharge line at the hydraulic liquid discharge side from the hydraulic actuator is lower. That is, the pressure difference between the first supply/discharge line and the second supply/discharge line being great means that necessary thrust or necessary torque for the hydraulic actuator is great. Also, the volume of the pump being small means that the speed reduction ratio is high. Therefore, according to the above-described configuration, even when the rotational speed and the torque of the electric motor are constant, the speed reduction ratio is changeable in accordance with necessary thrust or necessary torque for the hydraulic actuator.

The pump may include: a rotary shaft; a cylinder block that rotates together with the rotary shaft, the cylinder block being provided with a plurality of cylinder bores formed therein; a plurality of pistons inserted in the plurality of cylinder bores, respectively; a port plate in which the pair of pump ports is formed; a swash plate that defines a stroke of each of the plurality of pistons; and a spring that presses the swash plate. The pump may be configured to generate, in accordance with a pressure difference between the pair of pump ports, a moment at which the pistons tilt the swash plate. According to this configuration, a mechanical unit that is constituted by the electric motor, the pump, and the hydraulic actuator can be made compact, and also, the tilting angle of the pump can be automatically changed in accordance with the pressure difference between the first supply/discharge line and the second supply/discharge line.

The hydraulic actuator may be a hydraulic cylinder that changes a joint angle between a pair of members that are swingably coupled to each other. According to this configuration, the hydraulic drive apparatus can be used for a joint of, for example, a humanoid robot or an industrial robot.

For example, the above hydraulic drive apparatus may further include a position sensor that detects a motor angle actual value that is a rotation angle of the electric motor. The control device may: determine a speed reduction ratio that corresponds to a tilting angle of the pump; calculate a motor angle command value for the electric motor by using the actuator position command value and the speed reduction ratio; and perform position feedback control by using the motor angle command value and the motor angle actual value detected by the position sensor.

The actuator position command value may be a joint angle command value for the joint angle between the pair of members. The above hydraulic drive apparatus may further include a position sensor that detects a joint angle actual value of the joint angle between the pair of members, and the control device may perform position feedback control by using the joint angle command value and a detection value of the joint angle actual value detected by the position sensor. According to this configuration, the movement position of the hydraulic actuator can be controlled with high precision even if the speed reduction ratio is not properly determined.

Advantageous Effects of Invention

The present invention makes it possible to change the speed reduction ratio in accordance with necessary thrust or necessary torque for the hydraulic actuator even when the rotational speed and the torque of the electric motor are constant.

DESCRIPTION OF EMBODIMENTS

Figure 1:
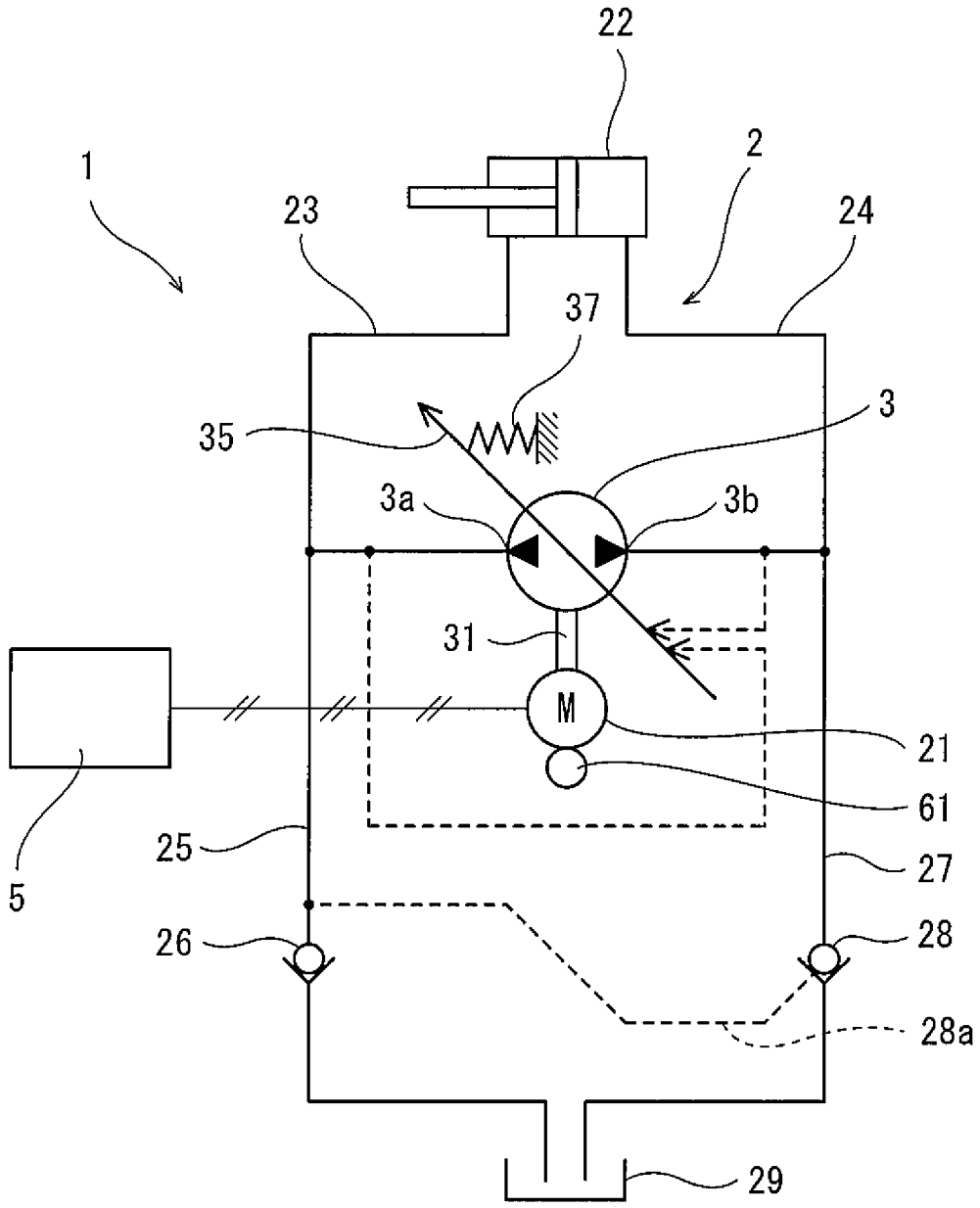
FIG. 1 shows a schematic configuration of a hydraulic drive apparatus according to one embodiment of the present invention.

FIG. 1 shows a hydraulic drive apparatus 1 according to one embodiment of the present invention. The hydraulic drive apparatus 1 includes a mechanical unit 2 and a control device 5.

Figure 2:
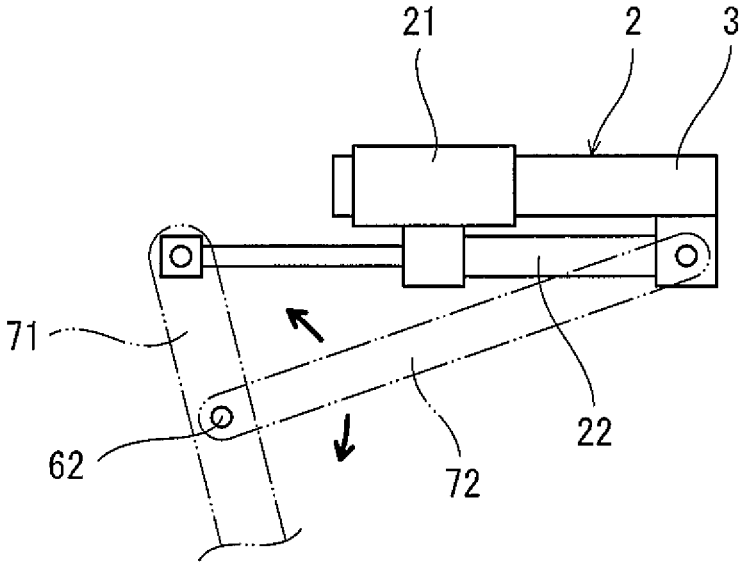
FIG. 2 shows a schematic configuration of a mechanical unit of the hydraulic drive apparatus shown in FIG. 1.

As shown in FIG. 2, the mechanical unit 2 is formed by integrating an electric motor 21, a pump 3, and a hydraulic actuator 22 together. Also, a small-volume reservoir chamber, which serves as a tank 29 (see FIG. 1), is formed on the mechanical unit 2.

In the present embodiment, the hydraulic actuator 22 is a single-rod hydraulic cylinder that changes a joint angle between a pair of members 71 and 72, which are swingably coupled to each other. For example, each of the members 71 and 72 is a robotic arm. Alternatively, the hydraulic actuator 22 may be a double-rod hydraulic cylinder. Further alternatively, the hydraulic actuator 22 may be a hydraulic motor.

The mechanical unit 2 is provided with a hydraulic circuit that includes the pump 3 and the hydraulic actuator 22. A hydraulic liquid that flows through the hydraulic circuit is typically oil, but may be a different liquid such as water.

The pump 3 includes a rotary shaft 31, which is coupled to the output shaft of the electric motor 21. That is, the pump 3 is driven by the electric motor 21. It should be noted that the rotary shaft 31 of the pump 3 may be directly coupled to the output shaft of the electric motor 21, or may be indirectly coupled to the output shaft of the electric motor 21 via, for example, a reduction gear.

The pump 3 includes a pair of pump ports 3*a* and 3*b*. The delivery side and the suction side of the pump ports 3*a* and 3*b* are switched with each other in accordance with the rotation direction of the electric motor 21. For example, when the electric motor 21 rotates in one direction, the pump port 3*a* acts as a suction port, and the pump port 3*b* acts as a delivery port. When the electric motor 21 rotates in the reverse direction, the pump port 3*b* acts as a suction port, and the pump port 3*a* acts as a delivery port.

The pump ports 3*a* and 3*b* of the pump 3 are connected to the hydraulic actuator 22 by a first supply/discharge line 23 and a second supply/discharge line 24. In the present embodiment, since the hydraulic actuator 22 is a single-rod hydraulic cylinder, the amount of hydraulic liquid supplied to the hydraulic actuator 22 and the amount of hydraulic liquid discharged from the hydraulic actuator 22 vary from each other. Accordingly, the first supply/discharge line 23 on the rod side of the hydraulic cylinder is connected to the tank 29 by a first adjustment line 25 provided with a check valve 26, and the second supply/discharge line 24 on the head side of the hydraulic cylinder is connected to the tank 29 by a second adjustment line 27 provided with a pilot check valve 28.

Each of the check valve 26 and the pilot check valve 28 allows a flow led from the tank 29 to pass through, but blocks the reverse flow. The pressure of the first supply/discharge line 23 is led through a pilot line 28*a* to the pilot check valve 28 provided on the second adjustment line 27. The pilot check valve 28 stops exerting the reverse flow blocking function when the pressure of the first supply/discharge line 23 has become higher than a setting pressure.

It should be noted that in a case where the hydraulic actuator 22 is a double-rod hydraulic cylinder or a hydraulic motor, the second adjustment line 27 may be provided with a simple check valve instead of the pilot check valve 28.

The pump 3 is a variable displacement pump. The pump 3 is configured such that the volume of the pump 3 (displacement volume per rotation) decreases in accordance with increase in a pressure difference between the first supply/discharge line 23 and the second supply/discharge line 24.

In the present embodiment, the pump 3 is a swash plate pump. The tilting angle of the pump 3 is automatically changed in accordance with the pressure difference between the first supply/discharge line 23 and the second supply/discharge line 24.

Figure 3:
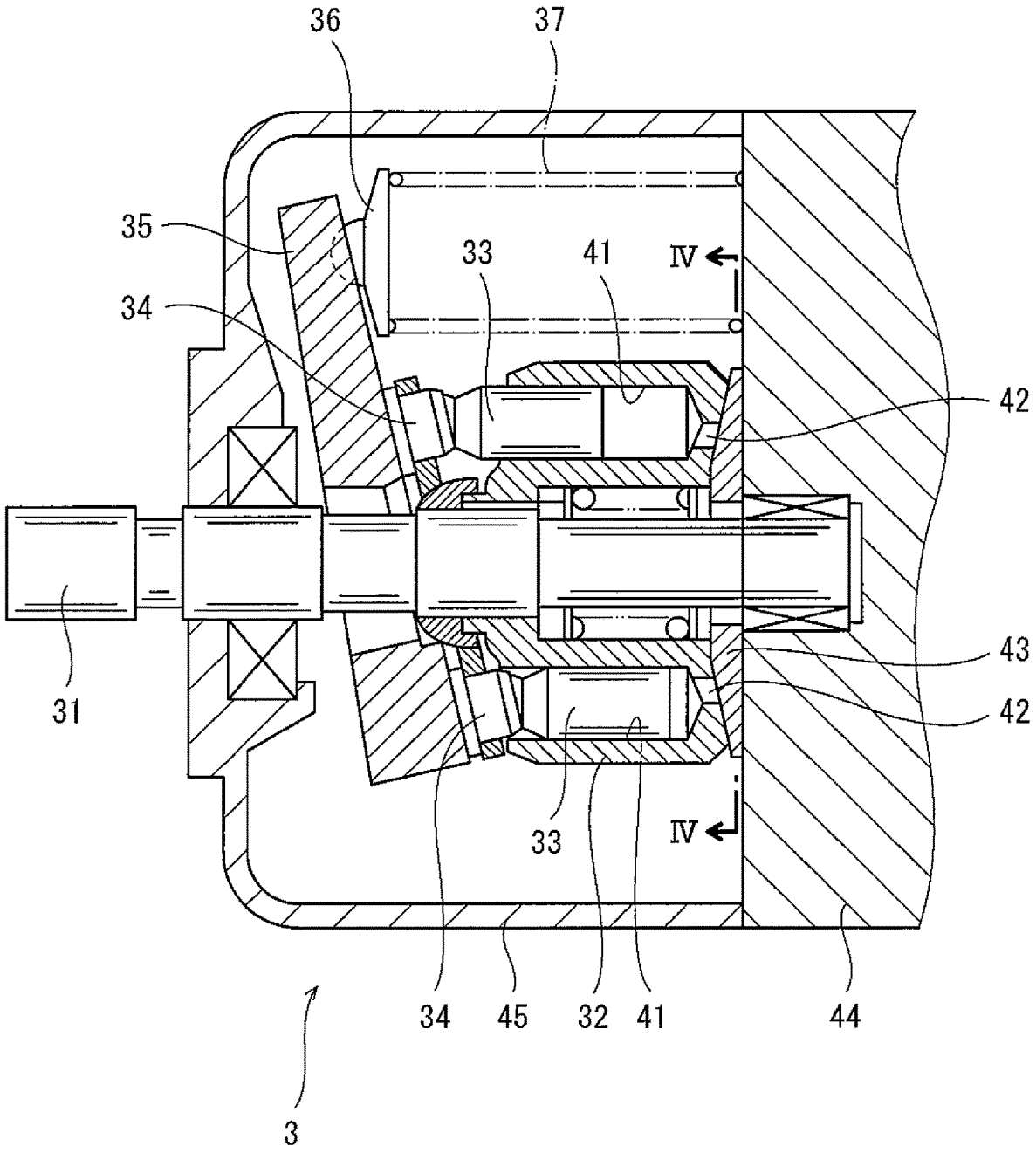
FIG. 3 is a sectional view of a pump.

Specifically, as shown in FIG. 3, the pump 3 includes a port block 44 and a casing 45, which support the aforementioned rotary shaft 31 via a bearing in a rotatable manner. Components such as a port plate 43, a cylinder block 32, and a swash plate 35 are accommodated in a space surrounded by the port block 44 and the casing 45.

The cylinder block 32 rotates together with the rotary shaft 31. A plurality of cylinder bores 41 are formed in the cylinder block 32. A plurality of pistons 33 are inserted in the plurality of cylinder bores 41, respectively. In the cylinder block 32, communication passages 42 are further formed at the bottom of the respective cylinder bores 41.

The swash plate 35 defines the stroke of each of the pistons 33. To be more specific, a plurality of shoes 34 are each fitted to the head portion of a corresponding one of the pistons 33. These shoes 34 slide on the swash plate 35 in accordance with the rotation of the cylinder block 32. An angle formed by a sliding surface of the swash plate 35 on the shoe 34 side and a plane orthogonal to the rotary shaft 31 is the tilting angle of the pump 3.

In the present embodiment, a spring 37 is disposed at the side of the cylinder block 32. The spring 37 is interposed between the swash plate 35 and the port block 44, and presses the swash plate 35 in the axial direction of the rotary shaft 31 via a pressing plate 36.

Figure 4:
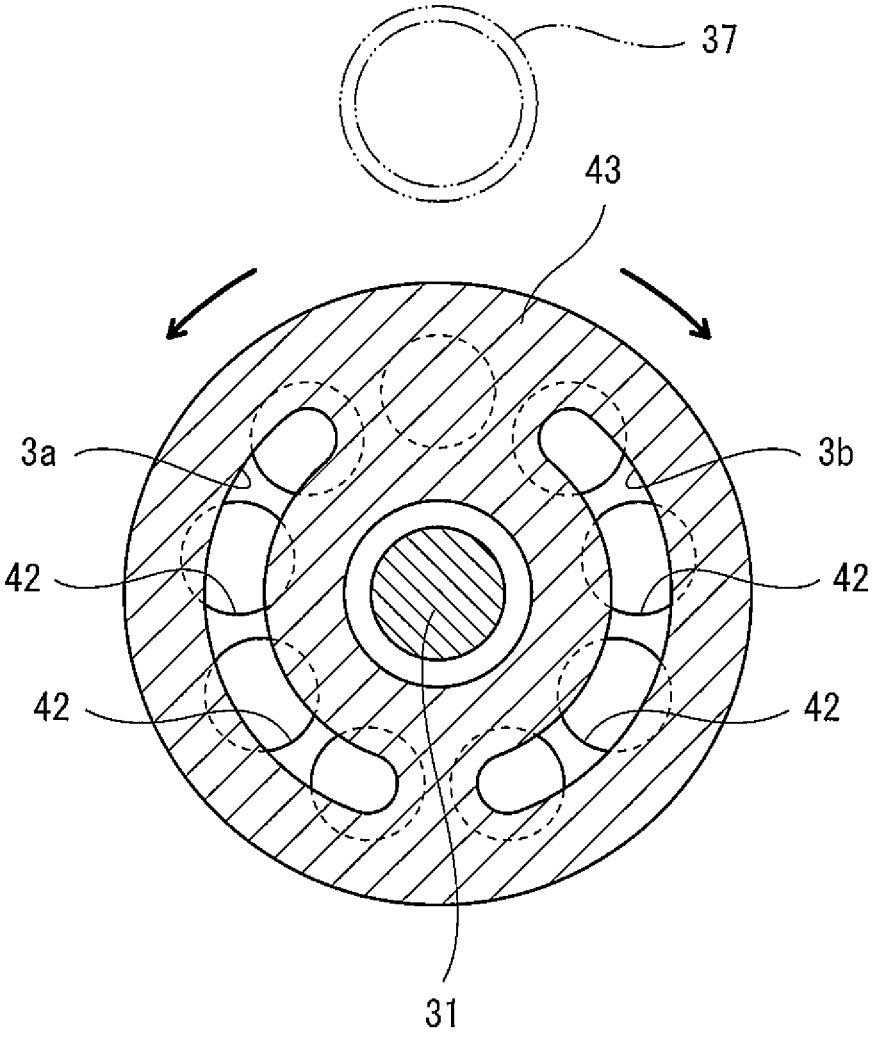
FIG. 4 is a sectional view taken along line IV-IV of FIG. 3.

The port plate 43 is fixed to the port block 44, and the cylinder block 32 slides on the port plate 43. As shown in FIG. 4, the aforementioned pump ports 3*a* and 3*b* are formed in the port plate 43. The communication passages 42 formed in the cylinder block 32 are, in one case, brought into communication with the pump ports 3*a* and 3*b*, and in another case, cut off from the pump ports 3*a* and 3*b*.

The pump 3 is configured to generate, in accordance with a pressure difference between the pump ports 3*a* and 3*b*, a moment at which the pistons 33 tilt the swash plate 35. In the present embodiment, the pump ports 3*a* and 3*b* have such a shape that when each of the pump ports is divided at the center of the rotary shaft 31 into a portion on one side where the spring is present, i.e., a portion on the spring-present side, and a portion on the other side where the spring is absent, i.e., a portion on the spring-absent side, the length of the portion on the spring-absent side is greater than the length of the portion on the spring-present side. Hereinafter, for the sake of convenience of the description, the spring-present side relative to the center of the rotary shaft 31 is referred to as the upper side, and the spring-absent side relative to the center of the rotary shaft 31 is referred to as the lower side.

Accordingly, regardless of which one of the pump ports 3*a* and 3*b* acts as a delivery port, at the delivery port, the force at which the pistons 33 press the lower portion of the swash plate 35 is greater than the force at which the pistons 33 press the upper portion of the swash plate 35. On the other hand, at the suction port, the force at which the pistons 33 press the lower portion of the swash plate 35 is less than the force at which the pistons 33 press the upper portion of the swash plate 35. Thus, in accordance with increase in delivery pressure, i.e., in accordance with increase in the pressure difference between the pump ports 3*a* and 3*b*, a moment at which the pistons 33 tilt the swash plate 35 against the urging force of the spring 37 in such a direction as to decrease the tilting angle of the pump 3 increases.

The aforementioned control device 5 controls the electric motor 21 based on an actuator position command value for the hydraulic actuator 22. For example, the control device 5 is a computer including a CPU and memories such as a ROM and RAM. The CPU executes a program stored in the ROM. It should be noted that the control device 5 may be a single device, or may be divided up into a plurality of devices.

Figure 5A:
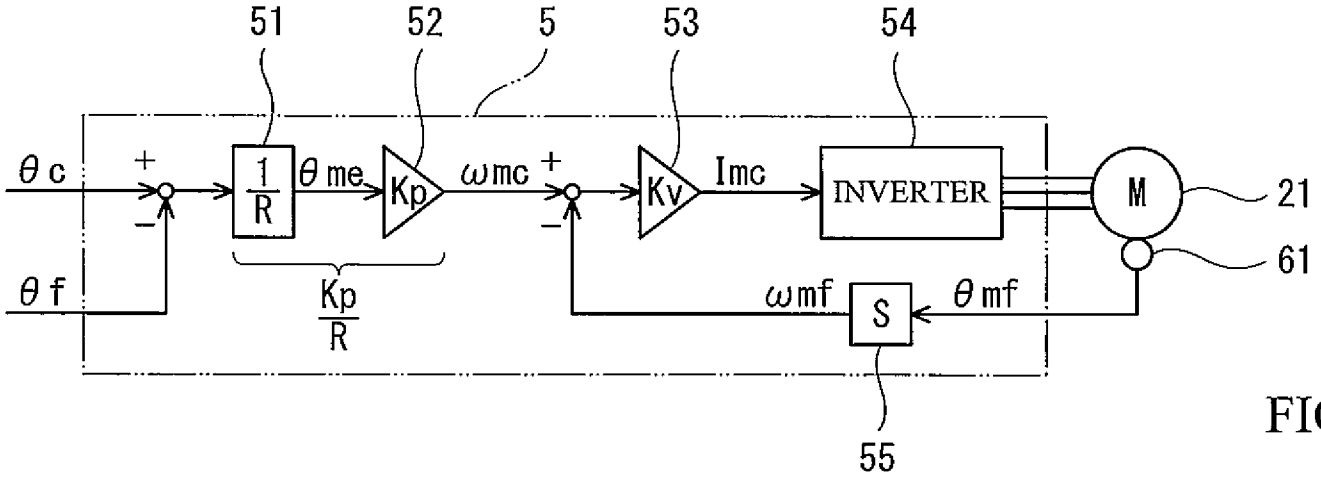
FIG. 5A is a block diagram showing the internal configuration of a control device of the present embodiment.

Specifically, as shown in FIG. 5A, the control device 5 includes a motor angle converter 51, a position controller 52, a speed controller 53, an inverter 54, and a differentiator 55. The control device 5 receives the actuator position command value, which is inputted from another device that is not shown. In the present embodiment, the actuator position command value is a joint angle command value θc for the joint angle between the members 71 and 72.

Further, in the present embodiment, the control device 5 is electrically connected to two encoders 61 and 62 (position sensors). As shown in FIG. 1, the encoder 61 is provided on the output shaft of the electric motor 21, and detects a motor angle actual value θmf, which is the rotation angle of the electric motor 21. As shown in FIG. 2, the encoder 62 is provided on a swing shaft that couples the members 71 and 72 together, and detects a joint angle actual value θf of the joint angle between the members 71 and 72.

It should be noted that, instead of the encoder 62, for example, a stroke sensor provided on the hydraulic cylinder serving as the hydraulic actuator 22 can be used as a position sensor that detects the joint angle actual value θf.

In the present embodiment, as shown in FIG. 5A, the control device 5 performs position feedback control by using: the joint angle command value θc; and the joint angle actual value θf between the members 71 and 72, which is detected by the encoder 62. The control device 5 also performs speed feedback control by using: a motor speed command value ωmc for the electric motor 21; and a derivative value (motor speed actual value) ωmf of the motor angle actual value θmf of the electric motor 21, which is detected by the encoder 61. Hereinafter, functions of the respective units of the control device 5 are described in detail.

The motor angle converter 51 determines a speed reduction ratio R, which corresponds to the tilting angle of the pump 3 and depends on a link mechanism of, for example, the members 71 and 72. The motor angle converter 51 calculates a motor position deviation θme for the electric motor 21 by using the joint angle command value θc and the speed reduction ratio R.

The speed reduction ratio R also depends on the pressure difference between the first supply/discharge line 23 and the second supply/discharge line 24. For example, the motor angle converter 51 calculates the speed reduction ratio R based on, for example, a detection value of a torque meter provided on the electric motor 21 or detection values of pressure meters provided on the first and second supply/discharge lines 23 and 24.

Then, the motor angle converter 51 calculates the motor position deviation θme for the electric motor 21 by dividing a deviation between the joint angle actual value θf detected by the encoder 62 and the joint angle command value θc between the members 71 and 72 by the speed reduction ratio R.

The position controller 52 calculates the motor speed command value ωmc for the electric motor 21 by multiplying the motor position deviation θme by a positional gain Kp. It should be noted that the control device 5 may calculate the motor speed command value ωmc by multiplying the deviation between the joint angle actual value θf detected by the encoder 62 and the joint angle command value θc between the members 71 and 72 by Kp/R without calculating the motor position deviation θme.

The differentiator 55 calculates the motor speed actual value ωmf by performing differentiation on the motor angle actual value θmf detected by the encoder 61. The speed controller 53 calculates a current command value Imc for the electric motor 21 by multiplying a deviation between the motor speed command value ωmc and the motor speed actual valueωmf by a speed gain Kv. The inverter 54 supplies electric power to the electric motor 21 based on the current command value Imc.

As described above, in the hydraulic drive apparatus 1 according to the present embodiment, the pump 3 is configured such that the volume of the pump 3 decreases in accordance with increase in the pressure difference between the first supply/discharge line 23 and the second supply/discharge line 24. Normally, the pressure of the supply/discharge line at the hydraulic oil supply side to the hydraulic actuator 22 is higher, and the pressure of the supply/discharge line at the hydraulic liquid discharge side from the hydraulic actuator 22 is lower. That is, the pressure difference between the first supply/discharge line 23 and the second supply/discharge line 24 being great means that necessary thrust for the hydraulic actuator 22, which is a hydraulic cylinder, is great. Also, the volume of the pump 3 being small means that the speed reduction ratio R is high. Therefore, according to the hydraulic drive apparatus 1 of the present embodiment, even when the rotational speed and the torque of the electric motor 21 are constant, the speed reduction ratio R is changeable in accordance with necessary thrust for the hydraulic actuator 22.

Figure 6A:
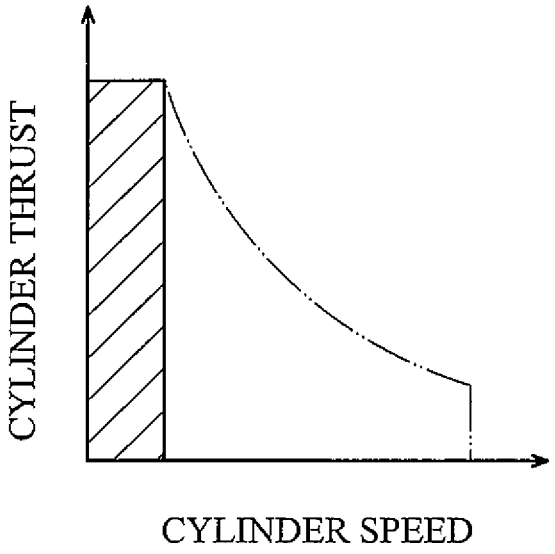
FIG. 6A shows a relationship between a cylinder speed and cylinder thrust in a case where the tilting angle of the pump is small.
Figure 6B:
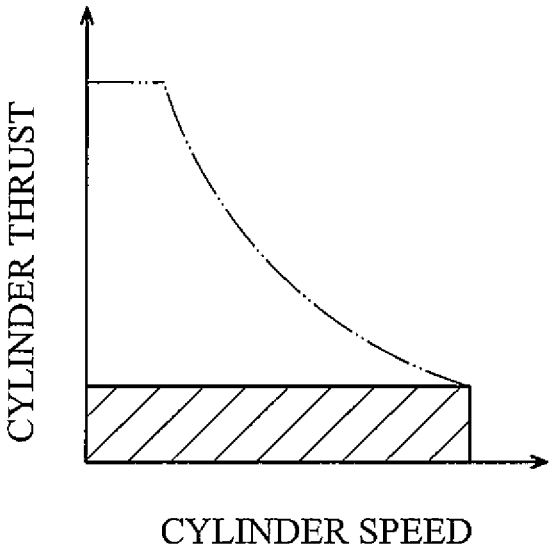
FIG. 6B shows a relationship between the cylinder speed and cylinder thrust in a case where the tilting angle of the pump is great.

For example, as shown in FIG. 6A, in a case where necessary thrust for the hydraulic actuator 22, which is a hydraulic cylinder, is great, the speed reduction ratio R can be made high since the pressure difference between the first supply/discharge line 23 and the second supply/discharge line 24 is great. On the other hand, as shown in FIG. 6B, in a case where necessary thrust for the hydraulic actuator 22 is small, the speed reduction ratio R can be made low since the pressure difference between the first supply/discharge line 23 and the second supply/discharge line 24 is small. It should be noted that a rectangular area that is formed by the cylinder thrust and the cylinder speed changes in accordance with a two-dot chain line shown in each of FIG. 6A and FIG. 6B.

In the present embodiment, the hydraulic actuator 22 is a hydraulic cylinder that changes the joint angle between the members 71 and 72. Therefore, the hydraulic drive apparatus 1 can be used for a joint of, for example, a humanoid robot or an industrial robot.

Figure 5B:
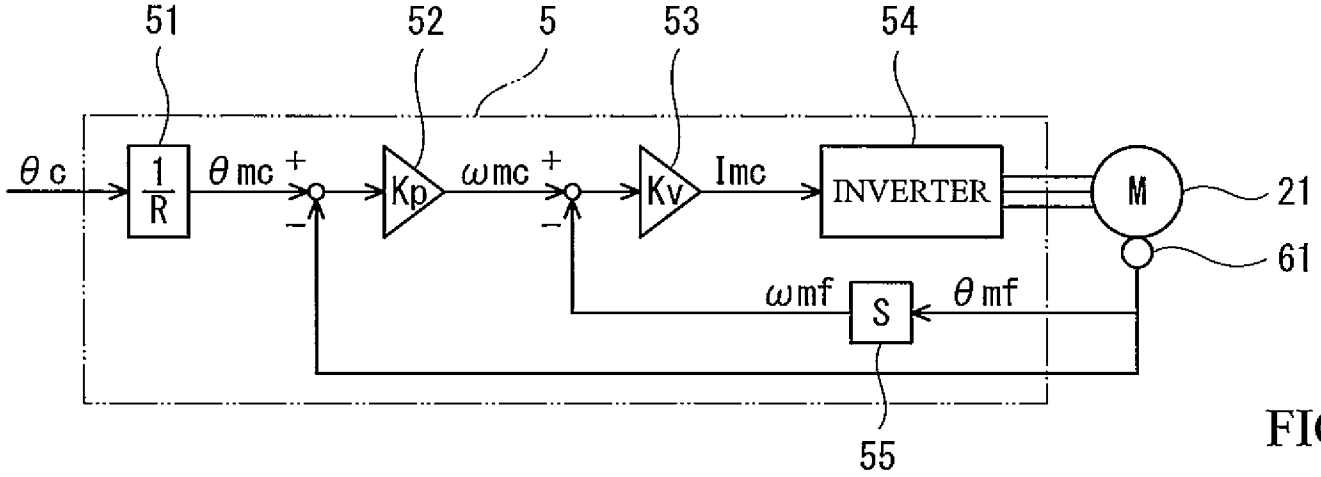
FIG. 5B is a block diagram showing the internal configuration of the control device according to a variation.

In the position feedback control performed by the control device 5, instead of the joint angle actual value θf between the members 71 and 72, which is detected by the encoder 62, the motor angle actual value θmf for the electric motor 21, which is detected by the encoder 61, may be used as shown in FIG. 5B. That is, the control device 5 may calculate a motor angle command value θmc by using the joint angle command value θc and the speed reduction ratio R, and perform the position feedback control by using the motor angle command value θmc and the motor angle actual value θmf. However, by performing the position feedback control by using the joint angle actual value θf between the members 71 and 72, which is detected by the encoder 62, as in the above-described embodiment, the movement position of the hydraulic actuator 22 can be controlled with high precision even if, for example, the speed reduction ratio R is not properly determined, or leakage of the hydraulic liquid from the hydraulic circuit occurs.

(Variations)

The present invention is not limited to the above-described embodiment. Various modifications can be made without departing from the spirit of the present invention.

For example, it is not essential that the tilting angle of the pump 3 be changed automatically. Alternatively, the tilting angle of the pump 3 may be changed by an electric actuator.

In the above-described embodiment, the pump 3 is a swash plate pump. However, as an alternative, the pump 3 may be a bent axis pump. Further alternatively, the pump 3 is not limited to a particular type of pump, so long as the pump 3 is a variable displacement pump. For example, the pump 3 may be a vane pump or a variable displacement gear pump. However, if the pump 3 is a swash plate pump as in the above-described embodiment, the mechanical unit 2, which is constituted by the electric motor 21, the pump 3, and the hydraulic actuator 22, can be made compact.

The control device 5 may perform sensorless control based on control theory that uses, for example, an OBSERVER.

REFERENCE SIGNS List

1 hydraulic drive apparatus
21 electric motor
22 hydraulic actuator
23 first supply/discharge line
24 second supply/discharge line
3 pump
3*a*, 3*b* pump port
31 rotary shaft
32 cylinder block
33 piston
35 swash plate
37 spring
41 cylinder bore
43 port plate
44 port block
5 control device
61, 62 encoder (position sensor)
71, 72 member

The invention claimed is:

1. A hydraulic drive apparatus comprising:

an electric motor;

a variable displacement pump driven by the electric motor, the pump including a pair of pump ports whose delivery side and suction side are switched with each other in accordance with a rotation direction of the electric motor;

a hydraulic actuator connected to the pair of pump ports by a first supply/discharge line and a second supply/discharge line; and a control device that controls the electric motor based on an actuator position command value for the hydraulic actuator, wherein:

the pump incudes:

a rotary shaft;

a cylinder block that rotates together with the rotary shaft, the cylinder block being provided with a plurality of cylinder bores formed therein;

a plurality of pistons inserted in the plurality of cylinder bores, respectively;

a port plate in which the pair of pump ports is formed;

a swash plate that defines a stroke of each of the plurality of pistons; and a spring that presses the swash plate, each of the pair of pump ports has such a shape that when each pump port is divided at a center of the rotary shaft into a portion on a spring-present side where the spring is present and a portion on a spring-absent side where the spring is absent, a length of the portion on the spring-absent side is greater than a length of the portion on the spring-present side, and the pump is configured to generate, in accordance with a pressure difference between the pair of pump ports, a moment at which the pistons tilt the swash plate.

2. The hydraulic drive apparatus according to claim 1, wherein the hydraulic actuator is a hydraulic cylinder that changes a joint angle between a pair of members that are swingably coupled to each other.

3. The hydraulic drive apparatus according to claim 2, wherein the actuator position command value is a joint angle command value for the joint angle between the pair of members, the hydraulic drive apparatus further comprises a position sensor that detects a joint angle actual value of the joint angle between the pair of members, and the control device performs position feedback control by using the joint angle command value and a detection value of the joint angle actual value detected by the position sensor.

4. The hydraulic drive apparatus according to claim 2, further comprising a position sensor that detects a motor angle actual value that is a rotation angle of the electric motor, wherein the control device:

determines a speed reduction ratio that corresponds to a tilting angle of the pump;

calculates a motor angle command value for the electric motor by using the actuator position command value and the speed reduction ratio; and performs position feedback control by using the motor angle command value and the motor angle actual value detected by the position sensor.

5. The hydraulic drive apparatus according to claim 1, further comprising a position sensor that detects a motor angle actual value that is a rotation angle of the electric motor, wherein the control device:

determines a speed reduction ratio that corresponds to a tilting angle of the pump;

calculates a motor angle command value for the electric motor by using the actuator position command value and the speed reduction ratio; and performs position feedback control by using the motor angle command value and the motor angle actual value detected by the position sensor.

* * * * *